US006179124B1

(12) United States Patent
Oka et al.

(10) Patent No.: US 6,179,124 B1
(45) Date of Patent: Jan. 30, 2001

(54) CONTAINER FOR LEAD REFILL

(75) Inventors: Shigeo Oka; Kazunari Takahashi, both of Tokyo (JP)

(73) Assignee: Pentel K.K. (JP)

( * ) Notice: Under 35 U.S.C. 154(b), the term of this patent shall be extended for 0 days.

(21) Appl. No.: 09/445,546

(22) PCT Filed: Apr. 13, 1999

(86) PCT No.: PCT/JP99/01975

§ 371 Date: Dec. 8, 1999

§ 102(e) Date: Dec. 8, 1999

(87) PCT Pub. No.: WO99/54150

PCT Pub. Date: Oct. 28, 1999

(30) Foreign Application Priority Data

| | | |
|---|---|---|
| Apr. 16, 1998 | (JP) | 10-122845 |
| Jul. 6, 1998 | (JP) | 10-205854 |
| Aug. 31, 1998 | (JP) | 10-260877 |
| Sep. 30, 1998 | (JP) | 10-292877 |
| Oct. 29, 1998 | (JP) | 10-324513 |

(51) Int. Cl.[7] ..... B65D 85/20
(52) U.S. Cl. ..... 206/443; 221/248; 220/839
(58) Field of Search ..... 206/214, 443; 221/248, 247, 268; 401/89; 220/836, 837, 839

(56) References Cited

U.S. PATENT DOCUMENTS

| | | | | |
|---|---|---|---|---|
| 3,648,891 | * | 3/1972 | Katz et al. | 221/248 |
| 3,815,734 | * | 6/1974 | Kruckel | 206/443 |
| 4,984,288 | * | 1/1991 | Petterson | 401/86 |
| 5,388,722 | * | 2/1995 | Kageyama | 221/186 |
| 5,480,249 | * | 1/1996 | Kageyama et al. | 401/60 |
| 5,720,643 | * | 2/1998 | Kageyama et al. | 401/60 |
| 5,788,118 | * | 8/1998 | Kageyama et al. | 221/306 |

FOREIGN PATENT DOCUMENTS

| | | | |
|---|---|---|---|
| 58-163290 | * | 10/1983 | (JP) . |
| 2-313 | * | 1/1990 | (JP) . |

* cited by examiner

*Primary Examiner*—David T. Fidei
(74) *Attorney, Agent, or Firm*—Adams & Wilks

(57) ABSTRACT

A spare lead storage case comprising a body having a top plate portion in an upper portion thereof and a lid portion attached to the boy, the lid portion including a lead expelling portion having a spare lead passage formed therein and a link mechanism having a control portion, the lead expelling portion and the link mechanism being disposed in a space above the top plate portion, the lead expelling portion being connected to a side wall of the body through a movable portion, the link mechanism being connected to the lead expelling portion through a movable portion, the lead expelling portion being brought into an upstanding state by moving the control portion, thereby allowing the spare lead passage of the lead expelling portion to communicate with an interior of the body.

7 Claims, 8 Drawing Sheets

CONTAINER FOR LEAD REFILL

TECHNICAL FIELD

The present invention relates to a case for storing spare leads, in which a lead expelling portion with a spare lead passage formed therein, disposed at an opening portion of a body is caused to project, when in use, from an upper surface of the body, so that leads can be supplied directly into a lead tank of a mechanical pencil.

BACKGROUND OF THE INVENTION

As a spare lead storage case of this type, there have heretofore been known those which are disclosed in Japanese Utility Model Unexamined Publication (Kokai) No. Sho 58-163290 (1983) and Japanese Utility Model Examined Publication (Kokoku) No. Hei 2-313 (1990).

In the invention disclosed in the Japanese Utility Model Unexamined Publication No. Sho 58-163290 (1983), there is disclosed a spare lead storage case including a body, a partition portion formed on either the body or a closure member attached to the body, an outlet port formed in the partition portion all the way therethrough, a fixing hole formed in either the body (or the closure member) or a flip member and a locking pin formed on the rest (the body or the flip member). The locking pin is rotatably inserted into the fixing hole such that an expelling port formed in the flip member longitudinally all the way therethrough and the outlet port formed in the partition portion are coincident with each other when the flip member is in its protruded state.

The utility model of the Japanese Utility Model Examined Publication No. Hei 2-313 (1990) discloses a spare lead storage case, in which a lid member having an external configuration readily inserted into a lead tank of a mechanical pencil and provided with a spare lead passage formed therein is turnably attached to an upper opening portion of a spare lead chamber in a body such that the spare lead passage and a spare lead storage chamber are linearly communicated with each other when the lid member is in an open position, a side wall of the opening portion, with which a basal portion of the lid member is abutted when the lid member is turned, is formed as a resilient wall and a maximum enlarged diameter portion of an outer periphery of the basal portion of the lid member urges the resilient wall so as to be displaced during the turning operation of the lid member, thereby opening and closing the lid member.

Any of the above conventional spare lead storage cases has such advantages that the lead expelling portion with the spare lead passage formed therein disposed at the opening portion of the body can be projected from the upper surface of the body in use and the lead stored in the body can be supplied directly into the lead tank of the mechanical pencil through the lead expelling portion.

However, there are such inconveniences involved in the above conventional devices that in order to project the lead expelling portion with the spare lead passage formed therein from the upper surface of the body in use, it is required to project the lead expelling portion by holding an end face thereof and therefore, lead powder deposited on the end face of the lead expelling portion is readily adhered to the user's hand to soil it and in addition, the operation is troublesome.

SUMMARY OF THE INVENTION

It is, therefore, an object of the present invention to provide a spare lead storage case, in which the user's hand is not soiled when a lead expelling portion with a spare lead passage formed therein is projected from the upper surface of a body in use and in addition, the operation is simple.

A first aspect of the present invention provides a spare lead storage case comprising a body having a top plate portion in an upper portion thereof and a lid portion attached to the boy, the lid portion including a lead expelling portion having a spare lead passage formed therein and a link mechanism having a control portion, the lead expelling portion and the link mechanism being disposed in a space above the top plate portion, the lead expelling portion being connected to a side wall of the body through a movable portion, the link mechanism being connected to the lead expelling portion through a movable portion, the lead expelling portion being brought into an upstanding state by moving the control portion, thereby allowing the spare lead passage of the lead expelling portion to communicate with an interior of the body.

A second aspect of the invention is to provide a space lead storage case comprising a body and a lid member disposed in and attached to an upper portion of the body, the lid member including a lead expelling portion having a spare lead passage, a link mechanism, a control portion and a lid portion, the link mechanism having two movable portions, one of the movable portions being connected to the lead expelling portion, a partition wall being formed on either the lead expelling portion or the body, the lid portion being opened and the lead expelling portion being raised upward by movement of the control portion so that at least a distal end portion of the lead expelling portion is allowed to project from an upper surface of the body.

In a third aspect of the invention, there is provided a spare lead storage case comprising a body and a lid member disposed in and attached to an upper portion of the body, the lid member including a top plate portion having a spare lead passing hole formed therein, a lead expelling portion having a spare lead passage formed therein and a link mechanism having a control portion, the lead expelling portion being connected to the top plate portion through a movable portion, the link mechanism being connected to the lead expelling portion through a movable portion, the lead expelling portion being brought into an upstanding state by turning the control portion, thereby allowing the spare lead passage of the lead expelling portion to communicate with the spare lead passing hole of the top plate portion.

BEST MODE FOR CARRYING OUT THE INVENTION

Figure 1:
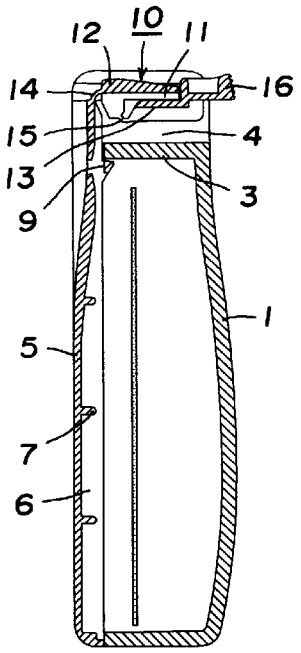
FIG. 1 is a sectional view of a spare lead storage case according to a first embodiment of the present invention.

Preferred embodiments of the present invention will be described hereinafter.

Referring first to FIGS. 1 to 5 showing a first embodiment of the present invention, a body 1 having a bottom has a horizontal U-shaped configuration in section. The body 1 has a top plate portion 3, which is smaller in width than a side wall 2, at an upper part thereof. A space 4 above the top plate 3 is a space for accommodating a lid member which will be described presently.

A side wall 5 is smaller in width than the first-mentioned side wall 2. The side wall 5 has a groove 6 formed therein in a longitudinal direction thereof. Reference numeral 7 denotes a plurality of projections (three in the illustration) formed in the groove 6. The reason for providing the projections 7 is that a possible adhesion between the body side wall and the leads caused by static electricity generated, when in use (when spare leads are supplied into a lead tank of a mechanical pencil), in the body can be prevented as much as possible by reducing a contact area with the leads. A lid member 10 has an attachment portion 8 with respect to the side wall 2, and a protrusion 9 having a hollow interior in section. The reason why this protrusion 9 is formed will be described presently in the specification.

The lid member 10 is formed on an upper end of the side wall 5 by means of integral molding or integral adhesion. This lid member 10 is accommodated in the space 4 above the body 1.

Figure 5:
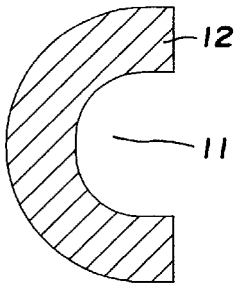
FIG. 5 is an enlarged end view taken on line A—A of FIG. 4.

The lid member 10 includes a lead expelling portion 12 having spare lead passage 11 formed therein, which passage 11 may be of a cylindrical configuration though it exhibits a C-shaped configuration in section in the illustration of FIG. 5, and a link mechanism 13. The side wall 5 and the lead expelling portion 12 are connected together through a movable portion 14, whereas the lead expelling portion 12 and the link mechanism 13 are connected together through a movable portion 15. It should be noted that although a bendable hinge portion having a proper dimensional configuration and made of a plate member is employed as the movable portion (the movable portion is hereinafter referred to as the "hinge portion") in the example to be described below, other means such as a pivotally movable pin, a ball joint, a plate spring or the like may be employed. It is also an interesting alternative that the hinge portion is made of elastomer or the like and formed by means of two-color molding.

As means for attaching the lid member 10 to the body 1, in this embodiment (in the illustration), the link mechanism 13 is provided with a projection 13*a* and the side wall 2 is provided with a recess in the form of a cavity 2*a*. By means of fitting engagement between the projection 13*a* and the cavity 2*a*, the lid member 10 is attached to the body 1. The height of the projection 13*a* is set smaller (for example, one half or less) than the depth (thickness of the side wall 2) of the cavity 2*a*. Owing to this arrangement, the projection 13*a* can easily be engaged with the cavity 2*a* and the projection 13*a* can be disengaged from the cavity 2*a* when an accidental external force is applied to a distal end of the lid member 10 in the state that the lid member 10 is in an open position, as will be described presently. Therefore, this part can be prevented from being broken. It is a matter of course that there is provided an engagement force large enough not to allow accidental disengagement during normal use. It is also accepted, in consideration of load applicable during the opening and closing operation of the lid member 10, that the cavity 2*a* is dimensioned slightly larger than the projection 13*a* in order to selectively determine or minimize play or looseness, thereby enhancing the smooth opening and closing operation of the lid member 10. The lid member 10 and the body 1 may be attached together by using a pin or the like instead of the projection 13*a*.

When the lid member 10 is attached to the body 1, a right end portion of the link mechanism 13 in the illustration projects outwardly from an outer peripheral surface of the body 1 and serves as a control portion 16. In this embodiment, it is illustrated that only the control portion 16 of the lid member 10 is allowed to project outwardly from the outer peripheral surface of the body 1 and the remaining portion is rested inwardly of the outer peripheral surface of the body 1 when the lid member 10 is in a closed position. However, it is not essentially required that the entire remaining portion is rested inwardly of the outer peripheral surface of the body 1 and, on the other hand, the remaining portion may partly project outwardly from the outer peripheral surface of the body 1.

The material of the body 1 is preferably synthetic resin or metal, while the material of the side wall 5 and the lid member 10 is preferably synthetic resin. The side wall 5 and the lid member 10 may be made of transparent synthetic resin.

A method of use and operation of the first embodiment will now be described.

Figure 3:
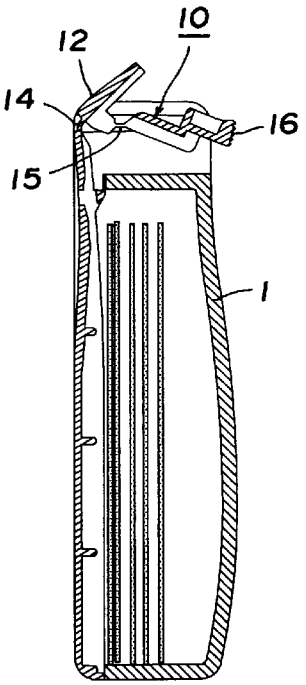
FIGS. 3 and 4 are explanatory views for explaining the operation of the spare lead storage case shown in FIGS. 1 and 2.

When the control portion 16 of the lid member 10 is moved downward in FIG. 1, the lead expelling portion 12 is turned by the hinge portions 14, 15 (the side wall 5 is designed such that it is capable of elastic deformation in an outward direction at that time) and begins to rise (see FIG. 3). When the control portion 16 is further moved downward, the lead expelling portion 12 is further turned so that it is brought into an upstanding state (see FIG. 4). At that time, the groove 6 of the side wall 5 and the spare lead passage 11 of the lead expelling portion 12 are in communication with each other. When the lead expelling portion 12 is directed downward so as to be aligned with an opening portion of a lead tank (not shown) of a mechanical pencil at that time, a lead L within the body 1 is dropped by its own weight so as to fill up the lead tank of the mechanical pencil.

Figure 2:
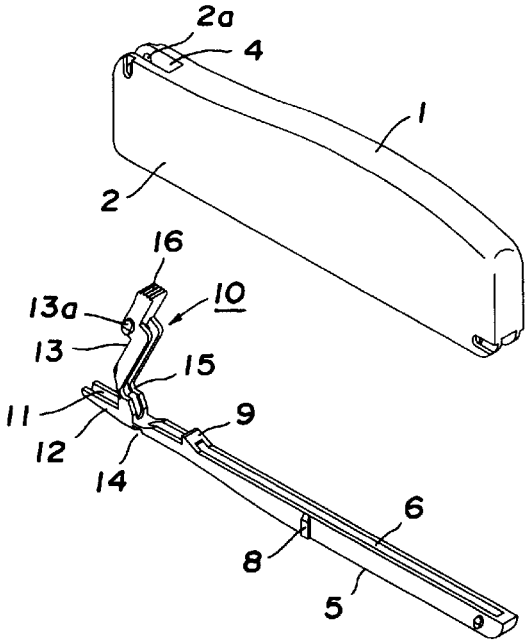
FIG. 2 is an exploded perspective view of the spare lead storage case of FIG. 1.
Figure 4:
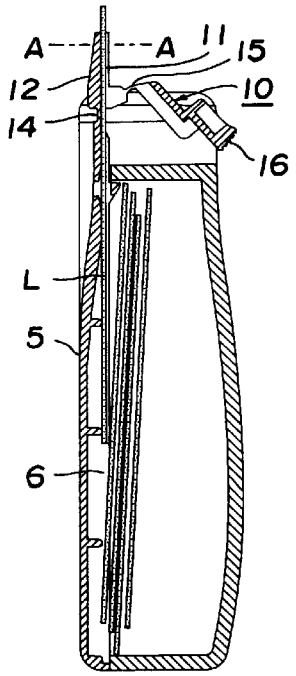

This hollow protrusion 9 has the function for restriction (or in other words, adjustment) so that several leads L will not be expelled all at a time into the spare lead passage 11 of the lead expelling portion 12 when the leads L within the body 1 are supplied into the lead tank of the mechanical pencil (see FIGS. 2 and 4).

In this embodiment, the lead expelling portion 12 can be put into a usable state merely by moving the control portion 16 downward. Therefore, an operation of the embodiment is easy compared with the structure of a second embodiment, which will be described later with reference to FIG. 15.

FIGS. 6 to 9 show a modification of the first embodiment of the present invention. Like parts of the above embodiment are denoted by like reference numerals and description thereof is omitted.

In the drawing, a plurality of projections 7 (six in the illustration) are formed in the groove 6 and adapted to prevent the occurrence of whisker (or burr) and bend during the molding operation.

Reference numerals 8, 8*a*, 8*b* denote attachment portions formed on the side wall 5. Specifically, holes 2*b*, 2*c*, 2*d* are formed in the side wall 2 of the body 1. The holes 2*b*, 2*c*, 2*d* are provided for engagement with the corresponding attachment portions 8, 8*a*, 8*b* of the side wall 5. Through engagement between the holes 2*b*, 2*c*, 2*d* and the corresponding attachment portions 8, 8*a*, 8*b* of the side wall 5, the side wall 5 is attached to the body 1. The side wall 5 may be attached to the body 1 by using pins or the like.

If a selected one of the holes 2, 2*c*, 2*d* is in the shape of a complete round and the remaining two holes are in the shape of an ellipse, non-uniform longitudinal dimensions of the side wall 5 can adequately be met and in addition, assembling performance of the side wall 5 with respect to the body 1 is also enhanced.

The attachment means for attaching the lid member 10 to the body I includes, in the illustrated example, a projection 13*a* formed on the link mechanism 13, and a hole 2*a* formed in the side wall 2. By way of engagement between the projection 13*a* and the hole 2*a*, the lid member 10 is attached to the body 1.

The side wall 5, which is connected to the lead expelling portion 12 of the lid member 10 through the hinge portion 14, is engaged with the hole 2*b* of the side wall 2 of the body 1 through the attachment portion 8. Therefore, the side wall 5 is prevented from moving with respect to the body 1. The sum of the lengths of two sides, namely a length of a link portion 12*a* from the hinge portion 14 to the hinge portion 15 and a length of a link portion 13*b* from the hinge portion 15 to the projection 13*a* of the link mechanism 13, is slightly longer than the distance from the hinge portion 14 to the projection 13*a* serving as a support point of the link mechanism 13, thus forming a so-called toggle mechanism.

The material of the body 1 is preferably synthetic resin or metal, and that of the side wall 5 and the lid member 10 is preferably synthetic resin. The material of the side wall and the lid member 10 may also be metal or hard rubber.

A method of use and operation of this example will now be described.

Figure 6:
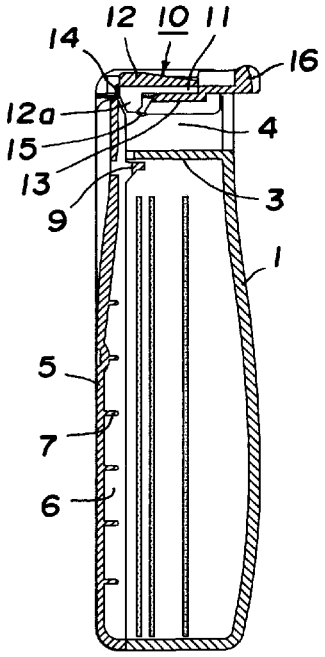
FIG.6 is a sectional view of a modified structure of the spare lead storage case according to the first embodiment of the present invention.
Figure 7:
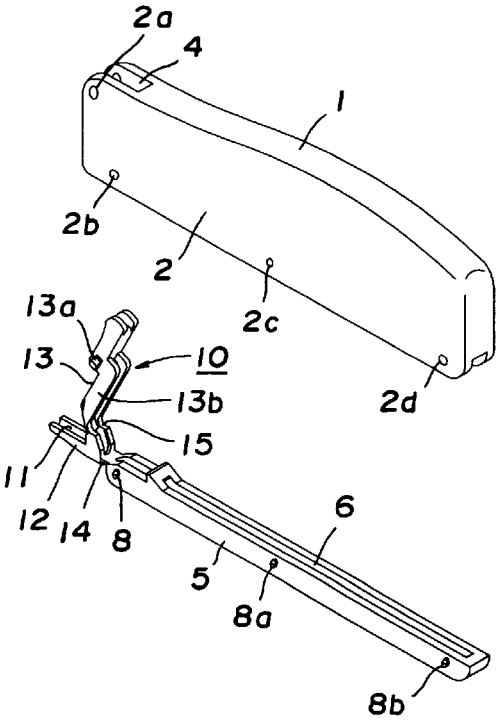
FIG. 7 is an exploded perspective view of the spare lead storage case of FIG. 6.
Figure 8:
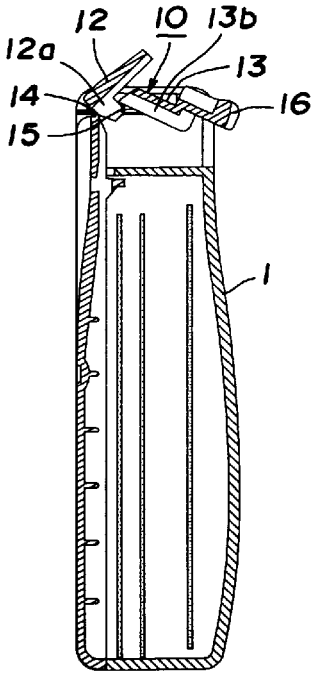
FIGS. 8 and 9 are explanatory views for explaining the operation of the modified structure shown in FIGS. 6 and 7
Figure 9:
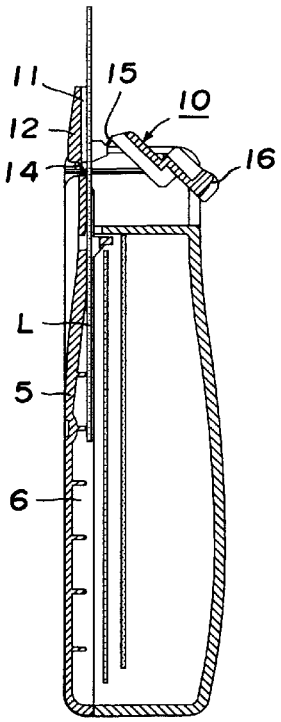

When the control portion 16 of the lid member 10 is moved downward in FIG. 6, the link portions 13*b*, 12*a* are moved upward through the hinge portion 15 and the lead expelling portion 12 integral with the link portion 12*a* is turned about the hinge portion 14 and begins to rise (see FIG. 8). The upper portion of the side wall 5 is prevented from movement because the attachment portion 8 is fixedly engaged with the hole 2*b* of the side wall 2. The upper portion of the side wall 5 may be designed such that it can resiliently be deformed slightly outwardly (hat is, leftward in the illustration).

When the control portion 16 is further moved downward, the link portions 12*a*, 13*b* from the hinge portion 14 to the hinge portion 15 are gradually brought into alignment with each other. At that time, because the sum of the link lengths of the two sides is set lightly longer than the distance between the hinge portion 14 and the support point 13*a* of the link mechanism 13, a rotational resistance load occurs due to toggle action when the hinge portion 15 passes over a straight line connecting the hinge portion 14 and the support point 13*a* of the link mechanism 13 together. And the downward movement of the control portion 16 becomes slightly heavier due to the resistance load. However, the hinge portion 15 passes by climbing over the straight line (i.e., point having a maximum value of the resistance value) connecting the hinge portion 14 and the support point 13*a* of the link mechanism 13 with the assistance of the hinge portions 14, 15 and the resilient deformation of the upper portion of the side wall 5. When the control portion 16 is further moved downward, the lead expelling portion 12 is further turned and brought into an upstanding state (see FIG. 9). However, even if the downward movement operation of the control portion 16 is stopped in the stage where the hinge portion 15 has climbed over the point having a maximum value, the lead expelling portion 12 is held in the upstanding state due to the toggle action. At that time, the groove 6 of the side wall 5 and the spare lead passage 11 of the lead expelling portion 12 are in communication with each other.

In that state, the lead expelling portion 12 is directed downward so as to be coincident with an opening portion of the lead tank (not shown) of the mechanical pencil. Then, the leads L within the body 1 are dropped by their own weights and filled up in the lead tank of the mechanical pencil.

The length of the link portion 12*a* of the lid member 10 from the hinge portion 14 to the hinge portion 15, the length of the link portion 13*b* from the hinge portion 15 to the projection 13*a* of the link mechanism 13, the position of the hinge portion 15 of the lid member 10 for connecting the link portions 12*a*, 13*b* with respect to the hinge portion 14 and the position of the hinge portion 15 with respect to the projection 13*a* of the link mechanism 13 are properly set in consideration of opening of the lid member, closing of the lid member and biasing load caused by the toggle action, so that when the lead expelling portion 12 is in the upstanding state, the hinge portion 15 is biased upward in order to maintain a linearly communicating state between the lead expelling portion 12 and the spare lead passage 11 and so that when the lead expelling portion is in a horizontal state, the hinge portion 15 is biased downward in order to positively maintain the lid member in a closed position. The toggle mechanism is also applied to the first embodiment. In this modified embodiment, however, since the toggle mechanism is more actively applied, the lead expelling portion 12 can more positively and stably be brought into a state of use.

FIGS. 10 to 13 show a further modification of the above modified embodiment. Like parts of the above modified embodiment are denoted by like reference numerals and description thereof is omitted.

In FIGS. 10 to 13, a hinge portion 14 is provided for connecting the side wall 5 and the lead expelling portion 12 together and a hinge portion 15 is provided for connecting the lead expelling portion 12 and the link mechanism 13 together. The hinge portions 14, 15 are each in the form of a thin flat plate (belt-like configuration). Each of one end portions 14*a*, 15*a* and each of the other end portions 14*b*, 15*b*, of the hinge portions 14, 15 are bendable. Further, the entire thin flat plate-like portions (belt-like portions) of the hinge portions 14, 15 from the one end portions 14*a*, 15*a* to the other end portions 14*b*, 15*b* are bendable. That is, the hinge portions 14, 15 are universal both in position and bending direction.

Figure 10:
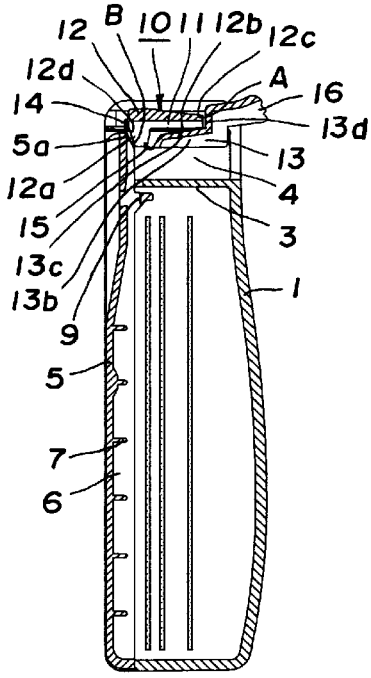
FIG. 10 is a sectional view of another modified structure of the first embodiment of the present invention.

FIG. 10 shows the state in which the lid member is in a closed position. A small gap portion A is formed between a surface 12*c* of the distal end portion of the lead expelling portion 12 and a surface 13*d* of the link mechanism 13 so that the small gap portion A serves to prevent the lid member from being insufficiently closed, possibly due to twisting. The surface 13*c* of the link mechanism 13 is slanted so that the surface 13*c* of the link portion 13*b* is slanted with respect to the surface 12*b* of the distal end portion of the lead expelling portion 12 (so that the distance between the surface 12*b* and the surface 13*c* is comparatively large at the area in the vicinity of the hinge portion 15 and gradually reduced in a direction away form the hinge portion 15). The both surfaces are contacted at the end portion of the lead expelling portion 12, which is away from the hinge portion 15, either the surface 12*b* of the lead expelling portion 12 or the surface of 13*c* of the link portion 13*b* is provided with a projection so that the surfaces 12*b* and 13*c* are contacted with each other by means of the thus formed projection. In this case, a surface 12*d* of the link is formed slanted so that a small gap B is provided also between the link portion 12*a* of the lead expelling portion 12 and the end portion 5*a* of the side wall 5. Further, the hinge portion 14 and the hinge portion 15 are formed in a belt-like configuration so that they have a flexibility and are bendable along their length and so that they are bent in accordance with the contact between the surface 12*b* of the lead expelling portion 12 and the surface 13*c* of the link portion 13*b* to thereby support the lead expelling portion 12.

In FIG. 10, the structure is disclosed that the end surface 12*b* of the lead expelling portion 12 and the surface 13*c* of the link 13*b* are contacted with each other but, instead, it may be possible to adapt a configuration that the end surface 12*c* of the lead expelling portion 12 is contacted with the surface 13*d* of the link mechanism 13 by means of a projection or other means of devices so long as the lead expelling portion 12 is contacted with the link portion 13 at a portion distal to or away from the hinge portion 15.

A manner of use and operation in this embodiment is substantially same as that of the first embodiment of the invention described above and, therefore, description will be omitted.

Figure 11:
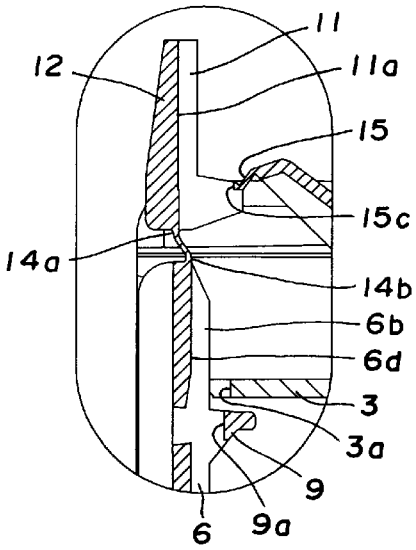
FIG. 11 is enlarged view of an essential portion of the modification shown in FIG. 10.

FIG. 11 is an enlarged view of a substantial portion of the elements in a state that the lead expelling portion 12 is in an upstanding position (that is, in an open lid position).

The groove 6, groove portion 6*b*, 6*c* have a bottom 6*d* for guiding the lead L. The spare lead passage 11 has a bottom surface 11*a*. In FIG. 11, the bottom surface 6*d* is positioned at a leftward position in the illustration relative to the bottom surface 6*d* to avoid any restrictions or difficulties in movement of the lead L when the lead L is dropped. Reference numeral 9*a* denotes an end face of the protrusion 9; 3*a*, an end face of the top plate portion; and 15*c*, an end face of the hinge portion 15, respectively. Because of the same reason as mentioned above, the end face 3*a* is located rightward of the end face 9*a* and the end face 15*c* is located rightward of the end face 3*a* in FIG. 11.

Figure 12:
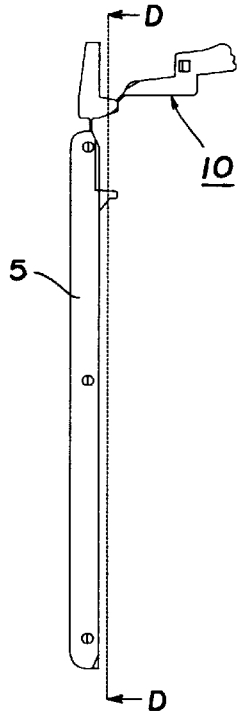
FIG. 12 is a front view showing a side wall and a lid member.
Figure 13:
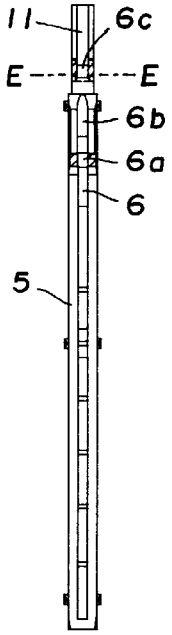
FIG. 13 is sectional view taken along line D—D of FIG. 12.

FIGS. 12 and 13 show the side wall 5 (and the lid member 10) not yet attached to the body 1. Reference numerals 6*a*, 6*b*, 6*c* denote groove portions which are continuous with the spare lead passage 11 from the groove 6 for guiding the lead L. The width of each groove is set such that the width of the groove portion 6*a* is slightly larger than that of the groove 6, the width of the groove 6*b* is slightly larger than that of the groove 6*a* and the width of the groove 6*c* is slightly larger than that of the groove 6*b*, so that the lead L is not caught and stopped in the midway of its dropping.

An end face taken on line E—E of the groove portion 6*c* exhibits a U-shaped configuration in FIG. 13. An upper portion of this U-shaped end face is set comparatively large in width (not shown). The reason is that when the upper portion of the U-shaped end face of the groove portion 6*c* is formed by resin molding or the like, this portion tends to be warped inwardly after molding and reduced in width, and therefore, the upper portion of the U-shaped end face is preliminarily set slightly larger in width.

For assembling the side wall 5 already attached with the lid member 10 to the body 1, the lid member 10 is folded into a closed state from that state (open state) of FIG. 12. By doing so, the side wall 5 can easily be attached to the body 1.

Figure 14:
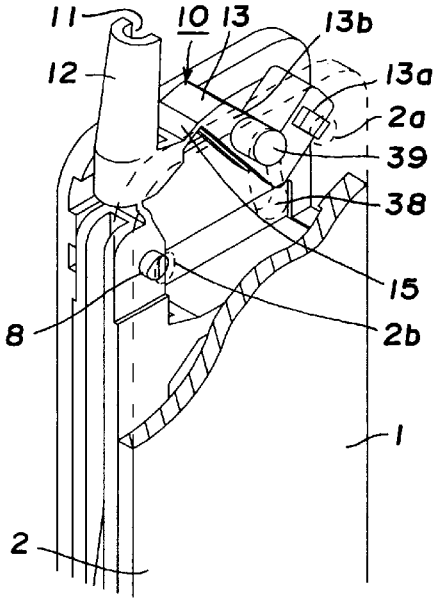
FIG. 14 is a perspective view showing a further modified structure of the first embodiment of the present invention.

FIG. 14 shows a modified example of the control portion 16 of the first embodiment of the present invention and of its modified embodiment.

In this modified example, an elongate slot 38 is formed in a front surface of the body 1 and the link mechanism 13 is provided with a control knob 39 at an area leftward of the link portion in the illustration and offset towards the hinge portion. This control knob 39 is allowed to project from the elongate slot 38 so as to serve as the control portion. In this arrangement, the projection 13*a* engaged with the hole 2*a* serves as a support point and the control knob 39 serves as a point of force.

In the method of use (operation), the body 1 is grasped by hand and the control knob 39 is pushed upward by the finger tip. By doing so, the lid member 10 is opened and the lead expelling portion 12 is fully raised up as shown in FIG. 10. For closing the lid member 10, the control knob 39 is pushed downward by the finger tip.

According to this modified example, since there is no protrusion on the outer peripheral surface of the body, the lateral width can be reduced. Moreover, since the direction for expelling the lead is coincident with the operating direction of the control knob 39, the feel of controlling operation is natural.

FIGS. 15 to 18 show a second embodiment of the present invention.

The body 1 having a bottom is formed with a stepped portion 1*a* (see FIG. 16) at an upper inner surface of a side wall (inner surface of one of the two side walls). A hole portion 1*b* is formed in an inner surface of the side wall of the opening portion of the body 1.

A lid member 10 is disposed within an upper portion of the body 1. The lid member 10 comprises a lead expelling portion 12 having a spare lead passage 11 and a partition wall 17 formed on a lower end side surface thereof, the lower end being in abutment relation to the stepped portion 1*a* of the body 1, a turnable link mechanism 18, a control portion 19 formed on an outer surface of the turnable link mechanism 18 and a lid portion 20. The turnable link mechanism 18 includes a hinge portion 21, a hinge portion 22 for connecting the lead expelling portion 12 and a resilient link portion 22*a*.

The lid member 10 is attached to the body 1 by bringing projections, which are formed on opposite outer surfaces of a central portion of the turnable link mechanism 18, into locking engagement with a hole formed in the body 1. In the alternative, they may be attached together by using a pin or the like. Although the lead expelling portion 12 is slidable in upward and downward directions along a hole (not shown) formed in an inner surface of a side wall of the opening portion of the body 1, it is prohibited from moving in a horizontal direction.

In the illustration, although the distal end portion of the lead expelling portion 12 is slanted in order to facilitate easy supply of the lead L contained in the lead tank of the mechanical pencil, it may be planar. Similarly, although the partition wall 17 is formed on a side surface of the lower end of the lead expelling portion 12, it may be formed on the body 1. In the case where the partition wall 17 is formed on the body 1, it is preferably formed in the location as shown in FIG. 15.

A method of use and operation of the second embodiment will now be described.

Figure 15:
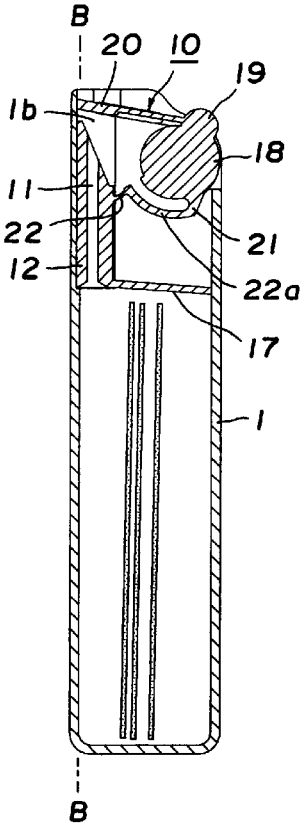
FIG. 15 is a sectional view of a spare lead storage case according to a second embodiment of the present invention.
Figure 16:
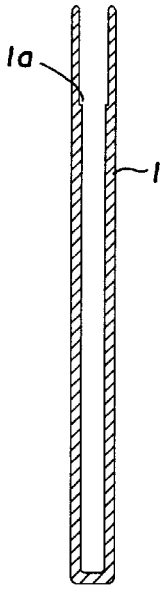
FIG. 16 is an end view, taken along line B—B, of only the body portion of the spare lead storage case shown in FIG. 15.
Figure 17:
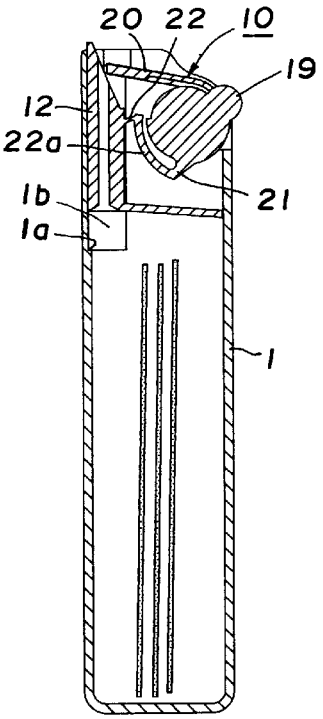
FIGS. 17 and 18 are explanatory views for explaining the operation of the storage case shown in FIG. 15.
Figure 18:
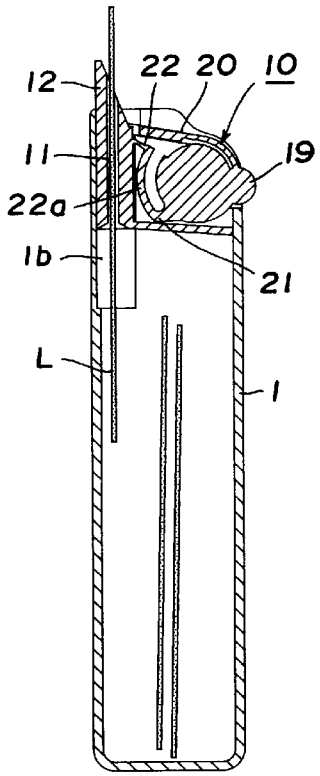

When the control portion 19 is rotationally moved downward in FIG. 15, the lid portion 20 is moved in the rotational direction and opened. At the same time, the turnable link mechanism 18 and the link portion 22*a* are moved upward through the hinge portions 21, 22 and the lead expelling portion 12, which is connected to the link portion 22*a* through the hinge portion 22, begins to rise upward while being guided by the hole portion 1*b* formed in an inner surface of the side wall of the body 1 (see FIG. 17).

When the control portion 19 is further moved downward, the link portion 22*a* extending from the hinge portion 21 to the hinge portion 22 begins to deflect towards the turnable link mechanism 18 by serving the hinge portion 21 as a basal point, against resiliency thereof. In the case where the lead expelling portion 12 is received in the body 1 (when the lid member is in a closed position), since the length and direction (and resiliency) of the link of the link portion 22*a* are set in such a manner as to be able to bias the lead expelling portion 12 downward, resistance load occurs against rotation caused by toggle action when the hinge portion 22 passes over a shortest line connecting the hole portion 1*b* formed in the inner surface of the side wall of the body 1 and the center of rotation of the turnable link mechanism 18 together. And the downward movement of the control portion 19 becomes slightly heavier due to the resistance load. However, the hinge portion 22 passes by climbing over the shortest line (i.e., point having a maximum value of the resistance value) connecting the hole portion 1*b* formed in the inner surface of the side wall of the body 1 and the center of rotation of the turnable link mechanism 18 with the assistance of the hinge portion 22 and the resilient deformation of the link portion 22*a*. When the lid portion 25 with a control portion is rotationally moved downward, the lead expelling portion 12 is further raised upward to allow the distal end of the lead expelling portion 12 to project from the upper surface of the body 1 (see FIG. 18). However, even if the downward movement operation of the control portion 16 is stopped in the stage where the hinge portion 22 has climbed over the point having a maximum value, the lead expelling portion 12 is held in the uppermost raised position due to the toggle action.

In that state, the lead expelling portion 12 is directed downward so as to be coincident with an opening portion of the lead tank (not shown) of the mechanical pencil. Then, the leads L within the body 1 are dropped by their own weights and filled up in the lead tank of the mechanical pencil.

Figure 19:
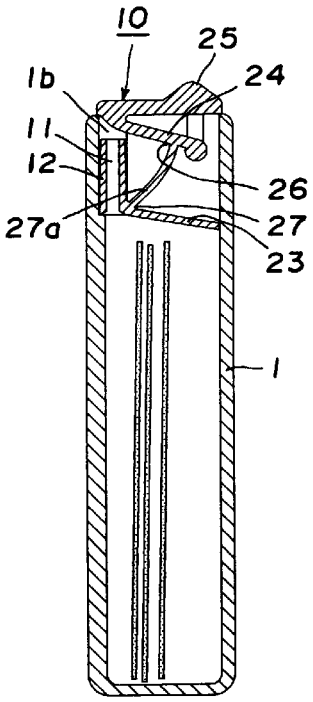
FIG. 19 is sectional view showing a modified embodiment of a spare lead storage case according to the second embodiment of the present invention.
Figure 20:
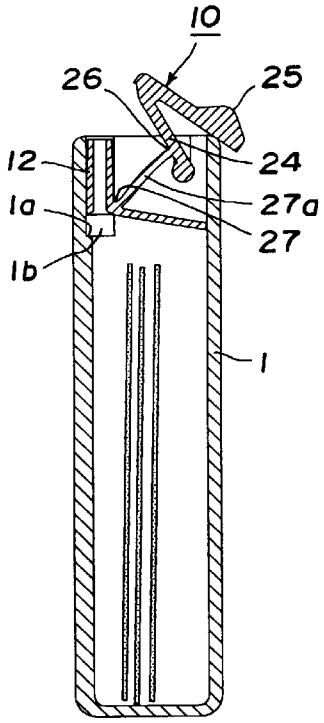
FIGS. 20 and 21 are explanatory views for explaining the operation of the modified structure shown in FIG. 19.
Figure 21:
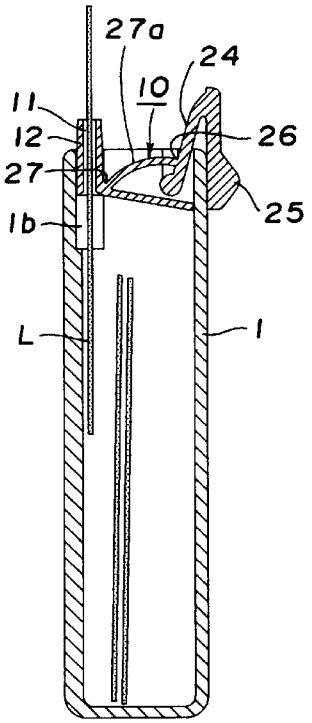

FIGS. 19 to 21 show a modified structure of the second embodiment of the present invention.

The body 1 having a bottom is formed with a stepped portion 1*a* (same as FIG. 16) at an upper inner surface of a side wall (that is, inner surface of one of the two side walls). A hole portion 1*b* is formed in an inner surface of the side wall of the opening portion of the body 1.

A lid member 10 is disposed within an upper portion of the body 1. The lid member 10 comprises a lead expelling portion 12 having a spare lead passage 11 and a partition wall 23 formed on a lower end side surface thereof, the lower end being in abutment relation to the stepped portion 1*a* of the body 1, a link mechanism 24, and a lid portion 25 with a control portion formed on an outer surface of the link mechanism 24. The link mechanism 24 includes a hinge portion 26, a hinge portion 27 for connecting the lead expelling portion 12 and a resilient link portion 27*a*.

The lid member 10 is attached to the body 1 by bringing projections, which are formed on opposite outer surfaces of a central portion of the link mechanism 24, into locking engagement with a hole formed in the body 1. In the alternative, they may be attached together by using a pin or the like. Although the lead expelling portion 12 is slidable in upward and downward directions along a hole (not shown) formed in an inner surface of a side wall of the opening portion of the body 1, it is prohibited from moving in a horizontal direction.

A method of use and operation of the modified structure of the second embodiment will now be described.

When the lid portion 25 with a control portion is moved in a lateral direction in FIG. 19, the lid portion 25 with a control portion is moved in the rotational direction and opened. At the same time, the link mechanism 24 and the link portion 27*a* are moved upward through the hinge portions 26, 27 and the lead expelling portion 12, which is connected to the link portion 27*a* through the hinge portion 27, begins to rise upward while being guided by the hole portion 1*b* formed in an inner surface of the side wall of the body 1 (see FIG. 20).

When the lid portion 25 with a control portion is further moved in a lateral direction, the link portion 27*a* extending from the hinge portion 26 to the hinge portion 27 begins to deflect serving the hinge portion 26 as a basal point, against resiliency thereof. In the case where the lead expelling portion 12 is received in the body 1, that is, when the lid portion 25 is in a closed position, since the length and direction (and resiliency) of the link of the link portion 27*a* are set in such a manner as to be able to bias the lead expelling portion 12 downward, resistance load occurs against rotation caused by toggle action when the hinge portion 27 passes over a shortest line connecting the hole portion 1*b* formed in the inner surface of the side wall of the body 1 and the center of rotation of the turnable link mechanism 18 together. And the lateral movement of the lid portion 25 with a control portion becomes slightly heavier due to the resistance load. However, the hinge portion 27 passes by climbing over the shortest line (i.e., point having a maximum value of the resistance value) connecting the hole portion 1*b* formed in the inner surface of the side wall of the body 1 and the center of rotation of the turnable link mechanism 18 with the assistance of the hinge portion 27 and the resilient deformation of the link portion 27*a*. When the control portion 19 is further moved downward, the lead expelling portion 12 is further raised upward to allow the distal end of the lead expelling portion 12 to project from the upper surface of the body 1 (see FIG. 21). However, even if the downward movement operation of the control portion 16 is stopped in the stage where the hinge portion 27 has climbed and passed over the point having a maximum value, the lead expelling portion 12 is held in the uppermost raised position due to the toggle action.

In that state, the lead expelling portion 12 is directed downward so as to be coincident with an opening portion of the lead tank (not shown) of the mechanical pencil. Then, the leads L within the body 1 are dropped by their own weights and filled up in the lead tank of the mechanical pencil.

In the illustration, although the partition wall 23 is formed on a side surface of the lower end of the lead expelling portion 12, it may be formed on the body 1. In the case where the partition wall 17 is formed on the body 1, it is preferably formed in the location as shown in FIG. 19.

In this modified embodiment, as well as in the examples of FIGS. 14 to 18, the lead expelling portion 12 is received within the body 1 when not in use and therefore, there is such an advantage that the lead powder deposited on the end face of the spare lead passage is not scattered.

Figure 22:
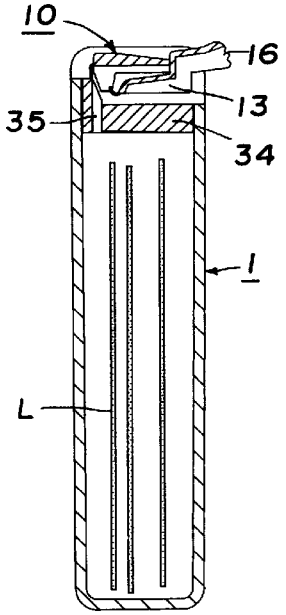
FIG. 22 is a sectional view of a spare lead storage case according to a third embodiment of the present invention.
Figure 23:
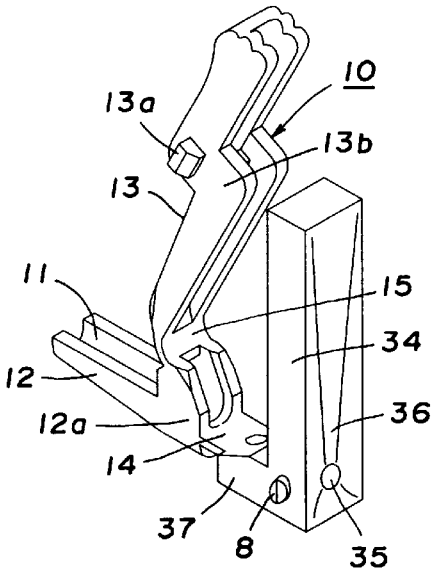
FIG.23 is a perspective view of a lid member for the spare lead storage case shown in FIG. 22.
Figure 24:
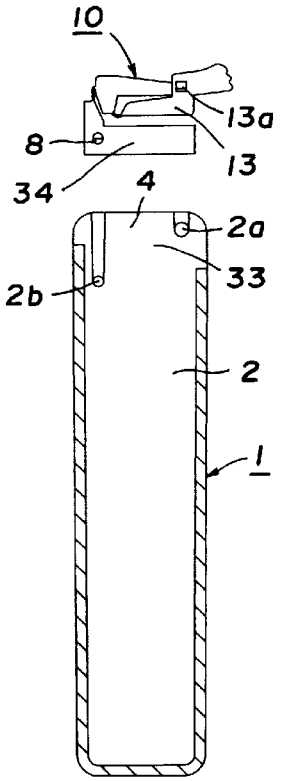
FIG. 24 is a front view of the lid member and a front vertical sectional view of a body portion of the third embodiment of the invention.
Figure 25:
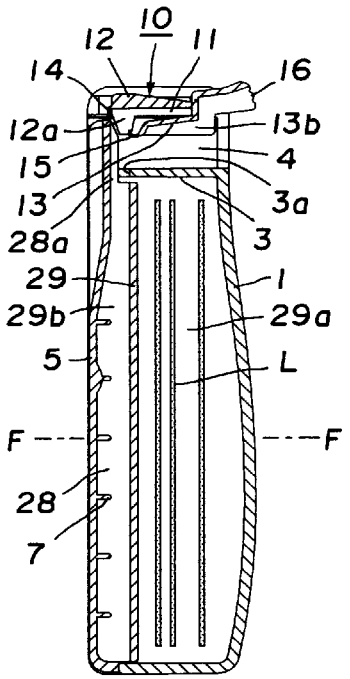
FIG. 25 is a sectional view showing a modified structure for each of the above respective embodiments of the present invention.
Figure 26:
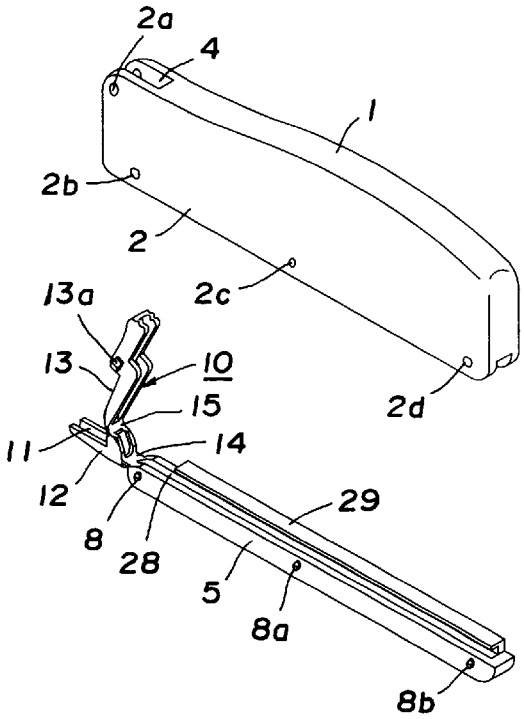
FIG. 26 is an exploded perspective of the modified structure shown in FIG. 25.
Figure 27:
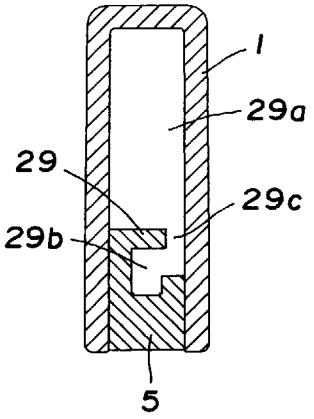
FIG. 27 is a sectional view of the spare lead storage case, taken along line F—F of PIG. 25.
Figure 28:
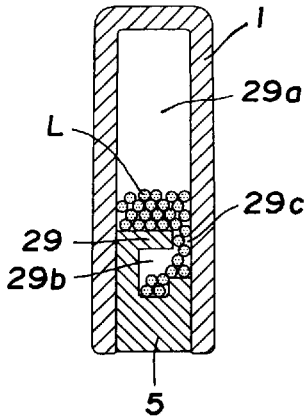
FIG. 28 is a sectional view showing the states in which leads are stored in the second lead storage chamber of FIG. 27.

FIGS. 22 to 24 show a third embodiment of the present invention. Like parts of the above embodiments are denoted by like reference numerals and description thereof is omitted.

A body 1 has a bottom and an upper portion of the body 1 is opened and has an open portion 33 opposite the side wall 2. A space 4 above the opening portion 33 serves as a space for disposing therein a lid member as later described.

Reference numeral 34 denotes a top plate portion having an L-shaped configuration which is smaller in width than the side wall 2. The top plate portion 34 has a passing hole 35 formed therein. This passing hole 35 serves as an outlet port for expelling the spare lead therethrough. A recess 36 is formed in a lower surface of the top plate portion 34. The recess 36 is adapted to guide a leading end of the spare lead in order to facilitate easy entry of the spare lead, which has been expelled from the body 1, into the passing hole 35. Reference numeral 8 denotes an attachment portion formed on the top plate portion 34 and reference numeral 37 denotes an upper end portion, as later described, of the top plate portion 34.

In this embodiment, the top plate portion 34 is formed in an L-shaped configuration. It is also accepted that a notch is formed in an intermediate portion of a member having, for example, a dogleg-shaped configuration or a linear configuration and then, the notched portion is bent into an L-shaped configuration. According to this method, an integral molding of a lid member, as later described, can more easily be obtained.

Reference numeral 10 denotes a lid member disposed in the upper space 4 of the body 1.

This lid member 10 includes the L-shaped top plate 34 having the passing hole 35 for allowing passage of the spare lead therethrough, a lead expelling portion 12 having a spare lead passage 11 (although this passage 11 has a C-shaped configuration in section in the illustration, it may have a sleeve-like configuration) formed therein and a link mechanism 13. The top plate portion 34 (more strictly, an upper end portion 37 of the top plate portion 34) and the lead expelling portion 12 are connected together through a movable portion and the lead expelling portion 12 and the link mechanism 13 are connected through a movable portion. The lid member 10 is formed by integral molding, integral fixture or the like.

Formed in the side wall 2 of the body 1 are a hole 2*b* which is engageable with the attachment portion 8 of the top plate portion 34 of the lid member 10 and a hole 2*a* which is engageable with the projection 13*a* formed on the link mechanism 13. By engaging the attachment portion 8 of the top plate portion 34 and the projection 13*a* formed on the link mechanism 13 with the holes 2*b* and 2*a*, respectively, the lid member 10 is attached to the body 1. In this embodiment, a concavo-convex fitting engagement device is employed as a means for attaching the lid member 10 to the body 1, but it should be appreciated that they may be attached by using a pin or the like. When the lid member 10 is attached to the body 1, an end portion of the link mechanism 13 is allowed to project outwardly of the outer peripheral surface of the body 1 so as to serve as a control portion 16.

The upper end portion 37 of the top plate portion 34 to which the lead expelling portion 12 of the lid member 10 is connected through the hinge portion 14, is prevented from movement with respect to the body 1 because the attachment portion 8 is engaged with the hole 2*b* formed in the side wall 2 of the body 1.

The attachment means of the lid member 10 should not be limited to that of the embodiment. For example, it is also an interesting alternative that a support pillar is provided at an upper portion of the right side, in FIG. 24, of the top plate portion 34, the projection 13*a* formed on the link mechanism 13 is engaged with this support pillar and then, the lid member 10 having the support pillar and already engaged with the projection 13*a* is attached to the hole 2*a* formed in the side wall 2 of the body 1. Owing to this arrangement, the spots for assembling the lid member 10 to the body 1 is reduced to only one and therefore, the lid member can more easily be assembled.

In a method of use and operation of this embodiment, when the control portion 16 is moved downward, the lead expelling portion 10 is raised and brought into a state of use as in the case with the first embodiment.

FIGS. 25 to 32 show several examples which can be applied to the above embodiments and modifications thereof.

In the example shown in FIGS. 25 to 28, the side wall 5 and a side wall ridge 29 define a first lead storage chamber

29*a* and a second lead storage chamber 29*b* which is smaller than the first lead storage chamber 29*a* within the case body 1. There is provided a gap 29*c* for allowing passage of the lead L from the first lead storage chamber 29*a* to the second lead storage chamber 29*b*.

A lead expelling port 28*a* is defined by an end face 3*a* of the top plate portion 3 and a groove 28 formed in the side wall 5. The area of the lead expelling port 28*a* is dimensioned smaller than the sectional area of the second lead storage chamber 29*b*, so that a plurality of leads will not slip down at a time when a lead is expelled. If there is no possibility or fear that a plurality of leads will slip down at a time because the sectional area of the second lead storage chamber 29*b* is so small, the area of the lead expelling port 28*a* may be dimensioned equal to the sectional area of the second lead storage chamber 29*b*.

The reasons why the side wall ridge 29 and the second lead storage chamber 29*b* are employed will be described hereinafter.

When the lead expelling portion 12 is directed downward to expel a lead for use, the lead L to be expelled comes out of the first lead storage chamber 29*a*, passes through the gap 29*c* and moves into the second lead storage chamber 29*b*. The remaining leads L stored in the first lead storage chamber 29*a* are stacked up on the side wall ridge 29 or in the gap 29*c*. That is, the side wall ridge 29 supports the remaining leads L so that the remaining leads L will not stack up and put their weights on the lead L to be expelled (see FIGS. 27 and 28).

When the lead expelling portion 12 is brought into alignment with a lead tank (not shown) of the mechanical pencil in that state, the lead L contained in the second lead storage chamber 29*b* is dropped down by its own weight and filled up in the lead tank of the mechanical pencil.

Figure 29:
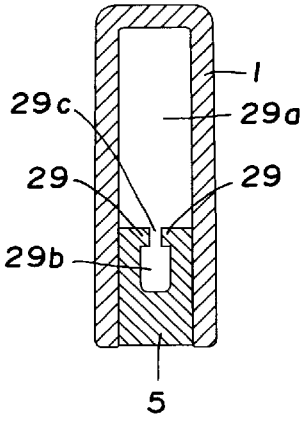
FIG. 29 is a view, corresponding to FIG. 27, showing another example of a side wall ridge.

FIG. 29 shows another example of the side wall ridge 29.

In this example, two side wall ridges 29 are formed on opposite U-shaped end portions, in cross section, of the side wall 5. A gap 29*c* is formed between the two side wall ridges 29. The width of the gap 29*c* may be properly set in consideration of the number of leads to be expelled (the width of the gap 29*c* in the preceding example may also be properly set and the same is applicable to the width of a gap in the embodiment to be described hereinafter).

Figure 30:
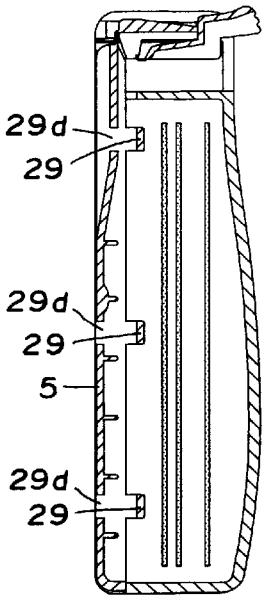
FIG. 30 is a sectional view showing another modified embodiment of the above respective embodiments of the present invention.

FIG. 30 shows an example in which the side wall 5 and the side wall ridge 29 are integrally molded from resin by injection molding. The lengthwise direction of the side wall ridge 29 is divided and punch holes 29 each having a generally equal dimension to that of the divided side wall ridge 29 are formed in a U-shaped bottom, in section, of the side wall 5. In the illustration, the side wall ridge 29 is divided into three. However, the side wall ridge 29 is not necessarily divided into three. It may be divided into any number of plural sections other than three inasmuch as the lead L can be expelled smoothly. And the dimension of each divided section may also be properly set.

Figure 31:
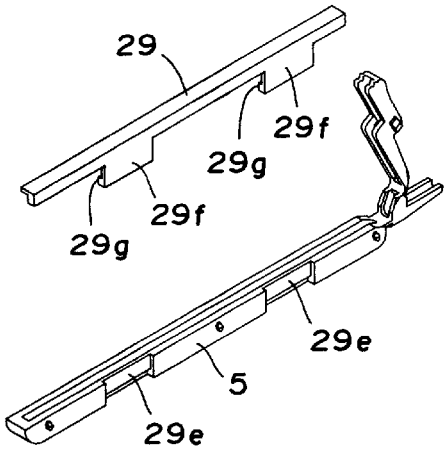
FIG. 31 is an exploded perspective view showing another example of the side wall and the side wall ridge of FIG. 30.

FIG. 31 shows the example in which the side wall 5 and the side wall ridge 29 are separately formed. The side wall 5 and the side wall ridge 29 are assembled into one piece by fixedly engaging recesses 29*e* with protrusions 29*f*. A lower end portion of each protrusion 29*f* is formed as an L-shaped portion 29*g*. The L-shaped portion 29*g* is adapted to fixedly hold the corresponding recess 29*e*.

Figure 32:
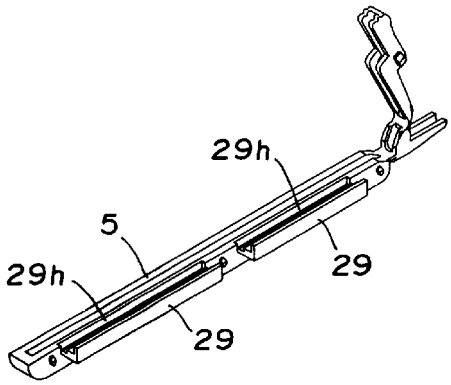
FIG. 32 is an exploded perspective view showing a further example of the side wall and the side wall ridge of FIG. 30.

FIG. 32 shows the example in which the side wall 5 and the side wall ridges 29 are integrally formed through hinge portions 29*h*. For assembling the side wall 5 to the body 1, the hinge portions 29*h* are bent. According to this embodiment, the side wall 5 and the side wall ridges 29 can be integrally formed in such a manner as to have a good outer appearance without forming such punch holes 29*d* as in the example shown in FIG. 30. Moreover, since there is no need for assembling such separate component parts as in the example shown in FIG. 31, productivity is enhanced.

A spare lead storage case according to a first aspect of the present invention comprises a body having a top plate portion in an upper portion thereof and a lid portion attached to the boy, the lid portion including a lead expelling portion having a spare lead passage formed therein and a link mechanism having a control portion, the lead expelling portion and the link mechanism being disposed in a space above the top plate portion, the lead expelling portion being connected to a side wall of the body through a movable portion, the link mechanism being connected to the lead expelling portion through a movable portion, the lead expelling portion being brought into an upstanding state by moving the control portion, thereby allowing the spare lead passage of the lead expelling portion to communicate with an interior of the body. A space lead storage case according to a second aspect of the present invention comprises a body and a lid member disposed in and attached to an upper portion of the body, the lid member including a lead expelling portion having a spare lead passage, a link mechanism, a control portion and a lid portion, the link mechanism having two movable portions, one of the movable portions being connected to the lead expelling portion, a partition wall being formed on either the lead expelling portion or the body, the lid portion being opened and the lead expelling portion being raised upward by movement of the control portion so that at least a distal end portion of the lead expelling portion is allowed to project from an upper surface of the body. A spare lead storage case according to a third aspect of the present invention comprises a body and a lid member disposed in and attached to an upper portion of the body, the lid member including a top plate portion having a spare lead passing hole formed therein, a lead expelling portion having a spare lead passage formed therein and a link mechanism having a control portion, the lead expelling portion being connected to the top plate portion through a movable portion, the link mechanism being connected to the lead expelling portion through a movable portion, the lead expelling portion being brought into an upstanding state by turning the control portion, thereby allowing the spare lead passage of the lead expelling portion to communicate with the spare lead passing hole of the top plate portion. Accordingly, operation is simple. Moreover, it is no more required to make a controlling by holding the end face of the lead expelling portion when the lead expelling portion is projected (when in use). Accordingly, there can be obviated such a problem that the user's hand is soiled by lead powder. In addition, a spare lead can be supplied directly into a lead tank of a mechanical pencil.

What is claimed is:

1. A spare lead storage case comprising: a body having a top plate portion in an upper portion thereof and a lid member attached to said body, said lid member including a lead expelling portion having a spare lead passage formed therein and a link mechanism having a control portion, said lead expelling portion and said link mechanism being disposed in a space above said top plate portion, said lead expelling portion being connected to a side wall of said lid member through a first movable portion, said link mechanism being connected to said lead expelling portion through a second movable portion, said lead expelling portion being brought into an upstanding state by moving said control portion, thereby allowing said spare lead passage of said lead expelling portion to communicate with an interior of said body.

2. A spare lead storage case according to claim 1, wherein said side wall of said lid member has an engagement portion for controlling movement of said first movable portion.

3. A spare lead storage case according to claim 2, wherein at least one of said movable portions is formed of a bendable flat plate, said lead expelling portion and said link mechanism are abutted with each other by a distal end of said lead expelling portion or by a projection formed on either said lead expelling portion or said link mechanism when said lid member is in a closed position, and a space is formed between said lead expelling portion and said side wall of said lid member.

4. A spare lead storage case comprising: a body and a lid member disposed in and attached to an upper portion of said body, said lid member including a lead expelling portion having a spare lead passage, a link mechanism, a control portion and a lid portion, said link mechanism having two movable portions, one of said movable portions being connected to said lead expelling portion, a partition wall being formed on either said lead expelling portion or said body, said lid portion being opened and said lead expelling portion being raised upward by movement of said control portion so that at least a distal end portion of said lead expelling portion is allowed to project from an upper surface of said body.

5. A spare lead storage case comprising: a body and a lid member disposed in and attached to an upper portion of said body, said lid member including a top plate portion having a spare lead passing hole formed therein, a lead expelling portion having a spare lead passage formed therein and a link mechanism having a control portion, said lead expelling portion being connected to said top plate portion through a first movable portion, said link mechanism being connected to said lead expelling portion through a second movable portion, said lead expelling portion being brought into an upstanding state by turning said control portion, thereby allowing said spare lead passage of said lead expelling portion to communicate with said spare lead passing hole of said top plate portion.

6. A spare lead storage case according to claim 5, wherein said lid member is integrally formed through said second movable portion and attached to an interior of said upper portion of said body.

7. A spare lead storage case according to one of claims 1 to 6, wherein a plurality of lead storage chambers are defined within said body, said plurality of lead storage chambers are communicated with each other such that said lead can pass therethrough and at least one of said plurality of lead storage chambers is linearly brought into communication with said lead expelling portion when in use.

* * * * *